US006438770B1

(12) United States Patent
Hed et al.

(10) Patent No.: US 6,438,770 B1
(45) Date of Patent: Aug. 27, 2002

(54) ELECTRONICALLY-CONTROLLED SHOWER SYSTEM

(75) Inventors: A. Ze'ev Hed, Nashua, NH (US); George Freedman, Wayland, MA (US); Richard Pavelle, Winchester, MA (US); Sol Aisenberg, Natick, MA (US); William M. Key, Atlanta, GA (US)

(73) Assignee: Invent Resources, Inc., Winchester, MA (US)

( * ) Notice: Subject to any disclaimer, the term of this patent is extended or adjusted under 35 U.S.C. 154(b) by 0 days.

(21) Appl. No.: 09/625,269

(22) Filed: Jul. 25, 2000

(51) Int. Cl.[7] ..... E03C 1/00
(52) U.S. Cl. ..... 4/668; 236/12.12
(58) Field of Search ..... 4/597, 605, 668, 4/695; 251/129.11; 236/12.12; 137/360

(56) References Cited

U.S. PATENT DOCUMENTS

| | | | | | |
|---|---|---|---|---|---|
| 4,398,789 | A | | 8/1983 | Pryor | 4/541.1 X |
| 4,409,694 | A | | 10/1983 | Barrett, Sr. et al. | 4/545 |
| 4,635,844 | A | | 1/1987 | Barrett, Sr. et al. | 236/12.12 |
| 4,923,116 | A | * | 5/1990 | Homan | 4/668 X |
| 4,945,943 | A | * | 8/1990 | Cogger | 4/668 X |
| 5,358,177 | A | * | 10/1994 | Cashmore | 236/12.12 |
| 5,459,890 | A | | 10/1995 | Jarocki | 4/668 |

* cited by examiner

*Primary Examiner*—Robert M. Fetsuga
(74) *Attorney, Agent, or Firm*—Kudirka & Jobse, LLP

(57) ABSTRACT

An apparatus for automating control of the water in a shower system includes at least one sensor disposable within a water flow path intermediate the valve and the showerhead. A processing unit operatively connectable to the sensor processes the sensor signal and generates control signals in response thereto. A valve control mechanism operatively connectable to the valve and the processing unit positions the valve in response to the control signals from the processing unit. A user interface operatively connectable to the processing unit receives user commands and displays values for the water temperature and flow rate. In the illustrative embodiment the processing unit is microprocessor based and enables previously defined vales for water temperature and flow rate to be stored and recalled in association with a particular user identifier.

11 Claims, 4 Drawing Sheets

ELECTRONICALLY-CONTROLLED SHOWER SYSTEM

FIELD OF THE INVENTION

The present invention relates to methods and systems for automatically controlling the water temperature and water flow in showers, such settings being predefined or definable upon each use of the shower.

BACKGROUND OF THE INVENTION

Currently, shower systems in bathrooms are manually controlled; i.e. by hand manipulation of faucets and mixer valves. Such manual controls have virtually disappeared in most other systems in the home, having been replaced by electronic controls. These embody keyboard input with instant readout and activate electromechanical implementation as required.

Phones no longer have rotary dials. TV sets no longer have knobs to turn, rather infrared remotes give all instructions. Microwave ovens are operated through a sealed keyboards, as do all the upscale lines of all other major appliances in today's homes. In fact, the most advanced washing machines already control water flow and temperature from keyboard entries. Thus, the time has come to extend this technology to the control of water flow and its temperature in the bathroom, especially since younger generations, trained from first grade to use computers, will readily accept it, and furthermore, there are significant segment of the population that require better automation such as the elderly and infirm.

While in general, electronic control of the temperature, and sometime the flow of water from a shower head has been known in the prior art, that art is lacking some important aspects, making its application either cumbersome or too costly.

For instance, U.S. Pat. No. 4,398,789 to Pryor describes an optoelectronically controlled bathing system which utilizes optical fibers to transmit control signals to a central processor and thus provide a plurality of control functions. Also, the system suggested in Pryor is cumbersome with a relatively low response time to reach desired temperature and flow rate, and furthermore, requires unique plumbing in which optical fibers are essentially integrated with the plumbing. The system proposed makes it very difficult to adapt to existing installations, and thus would require the complete replacement of the existing installation rather than a simple upgrading as contemplated herein. Further, the system does not provide for presetting the conditions desired for a plurality of household members, or resetting conditions in a remote fashion as contemplated herein.

Barrett et al. in U.S. Pat. Nos. 4,409,694 and 4,635,844 describe general electronic control devices for liquids. This system is quite complex as well, containing a large plurality of switches (at least nine) and solenoids (at least eight) making the system prone to malfunctions and costly. Furthermore, the system will be extremely difficult to install as an upgrade to an existing facility and the system does not provide for either local memorized setting of a plurality of preferred temperatures and flows and not for the remote setting of such parameters.

Jarocki, in U.S. Pat. No. 5,459,890 describes a water blending and recycling apparatus, this apparatus requires the control of at least 5 valves, and, in some embodiments, as many as seven valves. It would be difficult to just upgrade an existing shower installation with Jarocki's systems and furthermore it does not provide for a plurality of preset temperatures and flow, and, in essence, every user must reset his preferences before using the facility.

Accordingly, there is a need for an electronically controlled shower system in which a wide range of preset temperatures and flow rates can be selected by the individual user, without running the risk of being exposed to a water temperature that is either too high or too low. Such plurality of presets operational parameters could include, for instance, the "best" setting for each family member or the desired settings in institutions such as hotels or other facility where the requirements of many different users must be satisfied rapidly. Furthermore, there is a need for a shower system, which, once preset for each setting, such personalized settings can be easily be retrieved while in the shower.

There is further a need for such a system that can be installed as an upgrade to existing installations as well as a system for new construction.

There is further a need for such a system in which the setting and retrieving of preset conditions can be achieved remotely, for instance from a centralized "smart house" control console, or even remotely from a device connected to the internet, for instance as part of a "smart house concept, using neuron chips and software protocols.

There is a further need for an electronically controlled shower system, where the user can gradually increment or decrement the settings while in the shower, according to his own preference.

It is therefore an object of the present invention to provide a new and improved electronic control systems for water temperature and flow rate for showers that utilizes existing mechanical valves.

It is yet another object of the present invention that is easily adaptable to existing showers system.

It is another object of the invention to provide such shower systems that can be operated solely from a sealed keyboard within the shower stall, or from a remote location.

It is a further objective of the present invention, particularly for appropriate institutions (hospitals, nursing homes or even houses correction facilities etc.), to provide for only remote setting of the water temperature and flow rate.

SUMMARY OF THE INVENTION

The invention provides for an adaptation module that converts a purely mechanical shower valve, particularly one in which the axial motion (around the valve's axis) controls the admixture of hot and cold water, and the vertical motion (within a plane containing the valve's axis) the water flow rate, into an electronically controlled shower system.

The adaptation module includes sensors to monitor the temperature and flow rate of the water between the valve and the shower head. The module further includes a processor that provides for control strategies, memorization of a plurality of settings and communications and drive means to position the valve's handle or lever in response to the sensors reading and the processor's control algorithms.

In some embodiments of the invention, the shower operator has access only to the sealed controller/display module and the showering space itself is devoid of any handles or valves. In other embodiments of the invention, the water flow and temperature can be controlled directly by operating the valve's handle or through the sealed controller display module.

In yet another embodiment of the invention, the sensors unit, controller/display and the valve driving units are adapted to being installed and interfaced to an existing valve system.

In yet another embodiment of the invention, the controller unit is adapted to communicate either "over wiring" or wirelessly with a home or facility central unit to provide remote setting of the operational parameters of the shower, using standard operational protocols such as the "LonWork" standard from Echelon Corporation.

According to a first aspect of the present invention in a shower system having a shower head and a valve for controlling the admixture of hot and cold water to the shower head, the valve configured to move relative to an axis and having a lever coupled thereto, motion of the valve lever around the valve axis controlling the admixture of hot and cold water, and motion of the valve lever within a plane containing the valve axis controlling the water flow rate to the shower head, apparatus for controlling the water from the shower head comprising: (a) at least one sensor disposed within a water flow path intermediate the valve and the shower head and configured to generate a sensor signal; (b) a processing unit operatively coupled to the sensor and configured to process the sensor signal and generate control signals in response thereto; (c) a user interface operatively coupled to the processing unit and capable of receiving user commands; and (d) a valve control mechanism operatively coupled to the valve and the processing unit and configured to position the valve in response to the control signals from the processing unit.

According to a second aspect of the present invention in a shower system having a shower head and a valve for controlling the admixture of hot and cold water to the shower head, the valve configured to move relative to an axis and having a lever coupled thereto, motion of the valve lever around the valve axis controlling the admixture of hot and cold water, and motion of the valve lever within a plane containing the valve axis controlling the water flow rate to the shower head, a method for changing the characteristics of the water from the shower head comprising: (a) sensing a characteristic of water in a flow path intermediate the valve and the shower head; (b) processing the signal representing the sensed characteristic; and (c) generating a control signal usable by a valve control mechanism for modifying the valve position relative to the axis.

According to a third aspect of the present invention a kit comprising an apparatus for automating control of the water in a shower system, the apparatus comprising: (a) at least one sensor disposable within a water flow path intermediate the valve and the shower head and configured to generate a sensor signal; (b) a processing unit operatively connectable to the sensor and configured to process the sensor signal and generate control signals in response thereto; (c) a user interface operatively connectable to the processing unit and capable of receiving user commands; and (d) a valve control mechanism operatively connectable to the valve and the processing unit and configured to position the valve in response to the control signals from the processing unit.

DETAILED DESCRIPTION OF THE INVENTION

Figure 1:
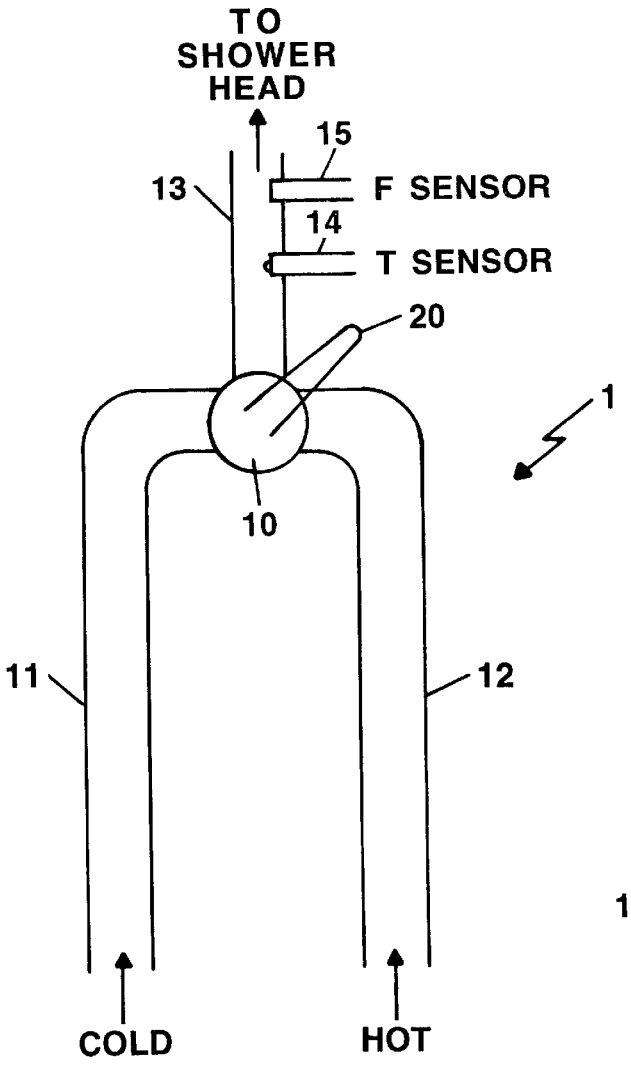
FIG. 1 illustrates a typical arrangement of the piping, valve and sensors used in the present invention.

FIG. 1 illustrates a system 1 including an arrangement of the piping, valve and sensors. Valve 10 may be implemented with a standard prior art valve in which a vertical motion of the valve lever controls the flow of water while the axial rotation of the valve lever controls the admixture of the streams from the hot and cold water sources respectively.

One such valve 10 is shown as a part of the inventive shower control system 1. Two pipes, 11 and 12 are connected to the input of the valve 10, pipe 11 carrying cold water, and pipe 12 hot water. The temperature of the incoming hot water is typically higher than the desired temperature of the output water (depending on the facilities water heating system, this temperature can be as high as 140° F., while it is rarely desired to shower in water temperature in excess of 1000 F.). The water from the valve's output is directed to pipe 13, in which a temperature sensor 14, and an electronic flow sensor 15, are sealably inserted, so as to measure respectively on a continuous basis, both the temperature and the flow rate of water on its way to the shower head. The signals from sensors 14 and 15 interface with an electronic processing unit. Sensors 14 and 15 may be implemented with any number of commercially available sensors.

The valve 10, can be moved in a plane containing its axis of rotation by a motor (or driver), 16 which causes extension and retraction of a drive shaft 17, so as to increase or decrease the flow rate of water through the valve. Similarly, valve 10 can be rotated around it axis of rotation by a stepper motor 18, driving a helical shaft. In some embodiments, the stepper motor 18 is mounted so as to rotate freely to allow for shaft 19 some angular motion (corresponding to the motion induced by the stepper motor 16). In other embodiments, shaft 19 is serrated and is pressure loaded against a toothed wheel, providing for the driving of the valve's shaft 20.

The drive shafts can be helical and driven by a screw type mechanism, or serrated and driven with a toothed wheel. However, it should be understood that any linear drive mechanism would achieve the intent of the present invention.

Figure 2:
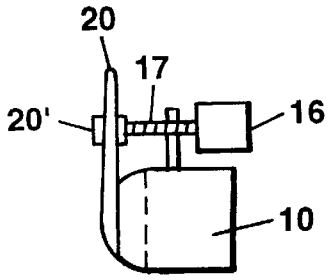
FIGS. 2 and 3 illustrate side and top view, respectively, of the valve and accompanying driving stepper motors in accordance with one embodiment of the invention.
Figure 3:
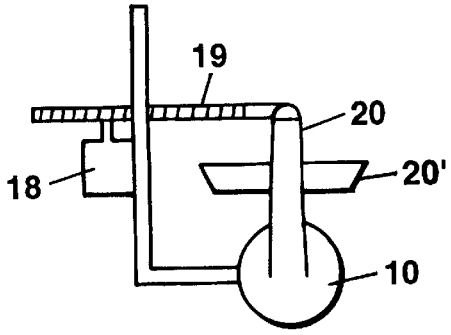
Figure 5:
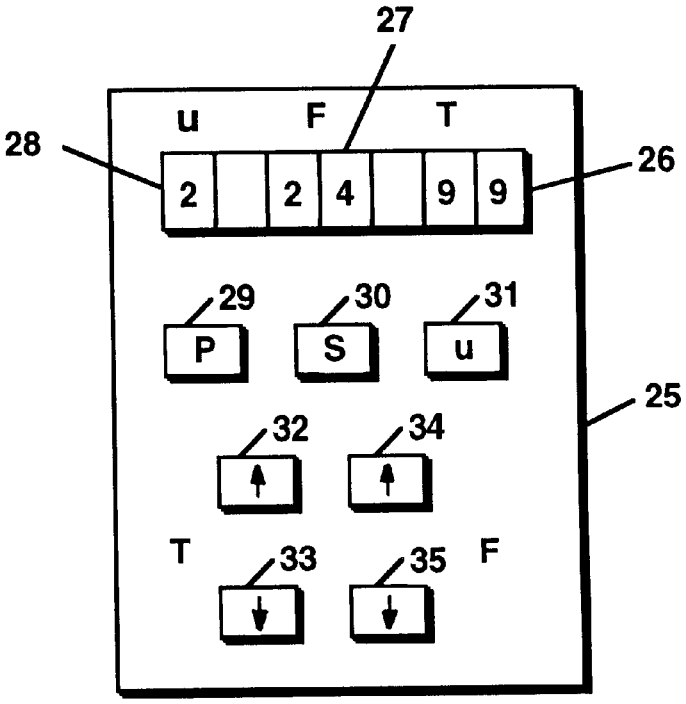
FIG. 5 illustrates a conceptual diagram of a display panel in one embodiment of the invention.

It should be understood that the system 1 shown in FIGS. 1–3 may be utilized when the shower stall itself is devoid of any valve controls and the operation is purely electronic from a sealed keyboard, similar to that shown in FIG. 5. This because the support for the driving mechanisms, and the drive themselves are not conducive to placement in a wet environment. Following is described an embodiment in which valve controls are placed within the shower stall and the driving mechanisms are sealed so as to allow placement in a wet environment.

In the present invention, stepper motors, under the control of a central processing unit (CPU) 21, actuate the two orthogonal movements of the valve. A temperature sensor 14 is provided to measure the output temperature of the water on its way to the shower head, on a continuous basis. Said temperature is compared to a preset temperature, which can be set through the display and controls unit 22, in FIG. 4. When a deviation from the preset temperature is identified, that difference is monitored by the CPU. The CPU then provides a signal to the stepper motor controlling the admixing lever in the axial direction of the valve to increase or decrease the ratio of the hot water and cold water provided. If the flow rate deviates from a preset flow rate, as set through the display and control system, the CPU will direct electronic drivers within the control units to actuate the stepper motor acting on the valve's lever within a plane containing the valve axis, until the correct flow rate is achieved.

In an alternative embodiment, a single stepper motor can control both orthogonal movements of the valve. For instance, the shaft of the single motor may be extended to include a two parts, the first part engaging only one drive assembly controlling the axial movement of the valve and the second part engaging an orthogonal drive to the first part to control the movement within a plane containing the valve's axis.

Any number of commercially available or "off the shelf" valves that enable both admixing and flow control through the same lever may be used to implement valve 10. With such valves, temperature control is achieved by apportioning the flows of the cold and hot water stream via lever movement, typically around the valve's axis. Water flow is controlled through lever movement in a plane containing the valve axis.

In FIGS. 2 and 3, the lever is attached to the vertical drive (the drive controlling flow) through an open slot that allows for movement in the orthogonal direction as well, but it should be understood that other mechanisms involving an articulating connection are possible as well described in more detail below.

Figure 4:
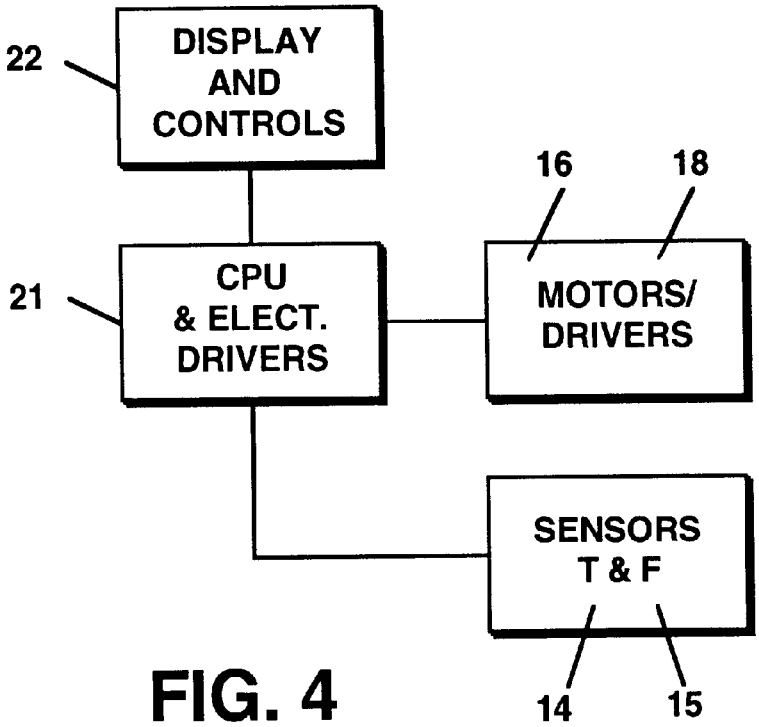
FIG. 4 illustrates a conceptual block diagram of the electronic and logical components of the system.

FIG. 4 illustrates a block diagram of the control system of the present invention. Control system 100 comprises a central processing unit for receiving signals from the sensors 14 or 15, a power supply, appropriate A/D converters for converting the analog signals from the sensors to digital signals that are processed by the CPU unit, a driver for the motors and display and control system. This unit also contains appropriate memory means. In the illustrative embodiment memory may be implemented with flash memory which maintains data without power. Part of the operating system resides on the memory. It should be clear, however, that one can use for the operating system and selected entries non-volatile memory, while using for computation and control and drive system volatile memory. The CPU and electronic driver unit 21, also contains appropriate electronic devices to send and receive information, either wirelessly, or over the facility's normal electronic wiring, using for instance, LonWork protocol and neural chip technology developed by Echelon Corporation, Sunnyvale, Calif.

FIG. 5 illustrates display and control system 25 having a minimal display. The display may be driven with low DC voltage provided from the main control unit 21, and is sufficient for displaying the water temperature (T), 26, the water flow (F), 27 and the user's I.D. (U), 28. Only a minimal interactive keypad, with, for example, only 7 pressure pads, is shown here. Three pads, 29, 30, and 31 are provided for selection of a parameter. Specifically, the pad 29 labeled "P" selects a parameter, the pad 30 labeled "S" is used to set the value of the parameter and pad 31 labeled "U" is used to enter the specific identification of the user. Similarly the pads 32 and 33 are used to increase or decrease the set temperature of the water and the pads 34 and 35 to increase or decrease the water's flow rate.

Other keypads including full numeric or even alpha numeric pads and displays could be used if so desired. For example, it may be desired that only the ID of the user be entered, and all other setting be centrally set, through a Lonwork type of communication protocol. The LonWork protocol is an ANSI-approved standard which provides an open, multi-industry platform for delivering control solutions in buildings and homes.

In the illustrative embodiment described in FIGS. 1–3, the only element of the system positioned in the shower stall is the keypad itself. Namely, the control unit 21 in its container, is within the stall's wall and only the keypad is exposed within the shower stall. The keypad may be a flexible screen type pressure keypad, such as is currently used in industrial hazardous environment, or in most food preparation or vending facilities.

In some embodiments of the invention, it may be desired to have only a minimal keyboard, with only an ID or an "On/Off" key-pad. For instance, in correction facilities, it may be desired to have a central setting of all the shower stalls. In hospitals, or nursing homes environment, it may be desired to have only an ID keypad, and having the settings set centrally, for each I.D. In such cases one can use a local facility communication network, based for instance on the LonWork protocol and Echelon's neuron chip, model that allows "in facility" communications on the existing electrical wiring of the facilities. It should be understood that within the framework of the "smart house" concept, the system described herein can communicate with the smart house's central processor in the same manner described above, and thus setting for various members of the household can be entered via said central control unit.

In yet another embodiment of the invention, it may be desired to adapt an existing shower stall and shower system to operate under the control of the present invention or to have a shower that can be operated either manually or electronically. Such a system is described in more details in FIGS. 6–7. Specifically, a system 2 includes a water valve 41 having a lever 42 which when rotated around the valve's axis to control the admixture of hot and cold water, and when rotated in a plane containing said axis, increases or decreases the water flow rate. The valve 42 is provided with a hot water input from a pipe 43 and a cold water input from a pipe 44. Water exists valve 41 through a third pipe 45. A tubular unit 46 can be easily threaded or cemented on the distal end of the pipe 45. The tubular structure 46 contains the system's sensor, a temperature measuring device, for instance, a thermistor, and an electronic flow rate measuring device 48. Signals from said sensors are directed through leads e.g. twisted pairs or simple pairs, 49 and 50, respectively, to the control/display unit 51.

Figure 7:
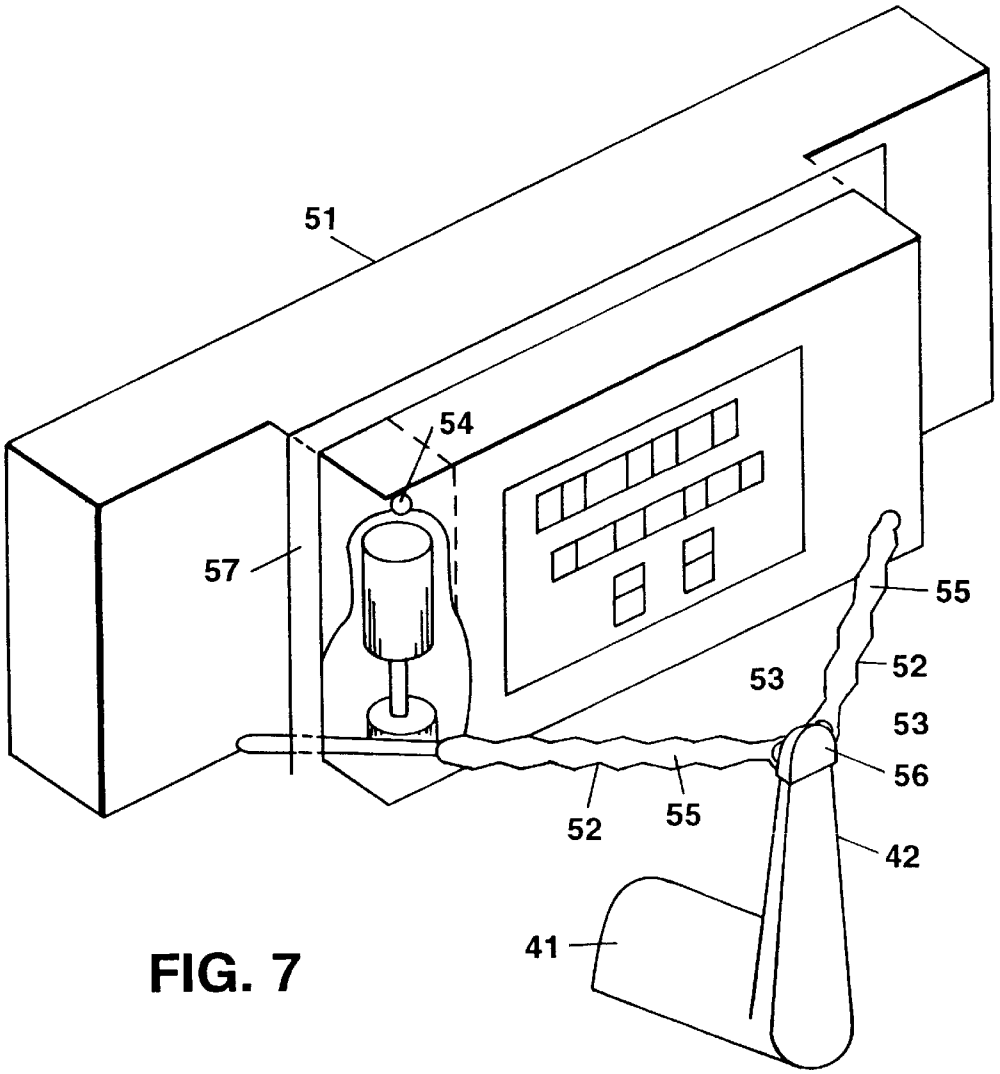
FIG. 7 is a view of the control system and its interface to the water valve.

The control/display unit 51 is provided with two linear drives 52, as shown in FIG. 7 that can be attached to the lever 42 to position said lever in response to the controller's signals.

It should be understood that the lever's top extreme tip will trace a segment of a sphere (having the radius of the lever itself) when driven through all possible settings. Therefore, the connection of the drives 52 to the lever is through articulating joints 53 (in essence a ball within a hollow segment of a sphere, slightly large than half a sphere, and typically, pressed fit within). Similarly, the stepper motor 54 is mounted on a free rotating mount to allow for angular deviations in following the movement of the drive 52. The drives 52 may be contained within sleeves, for instance bellows type sleeves, made of flexible material to keep the drive and the controller from being wet by the water from the shower. The drive assembly is terminated with an appropriate cap, 56, that can be mounted on the lever's end.

This mounting can be either permanent or easily dismounted as desired. When the stepper motors are not powered, their shaft rotate freely, thus operation of the lever is unhindered.

Figure 6:
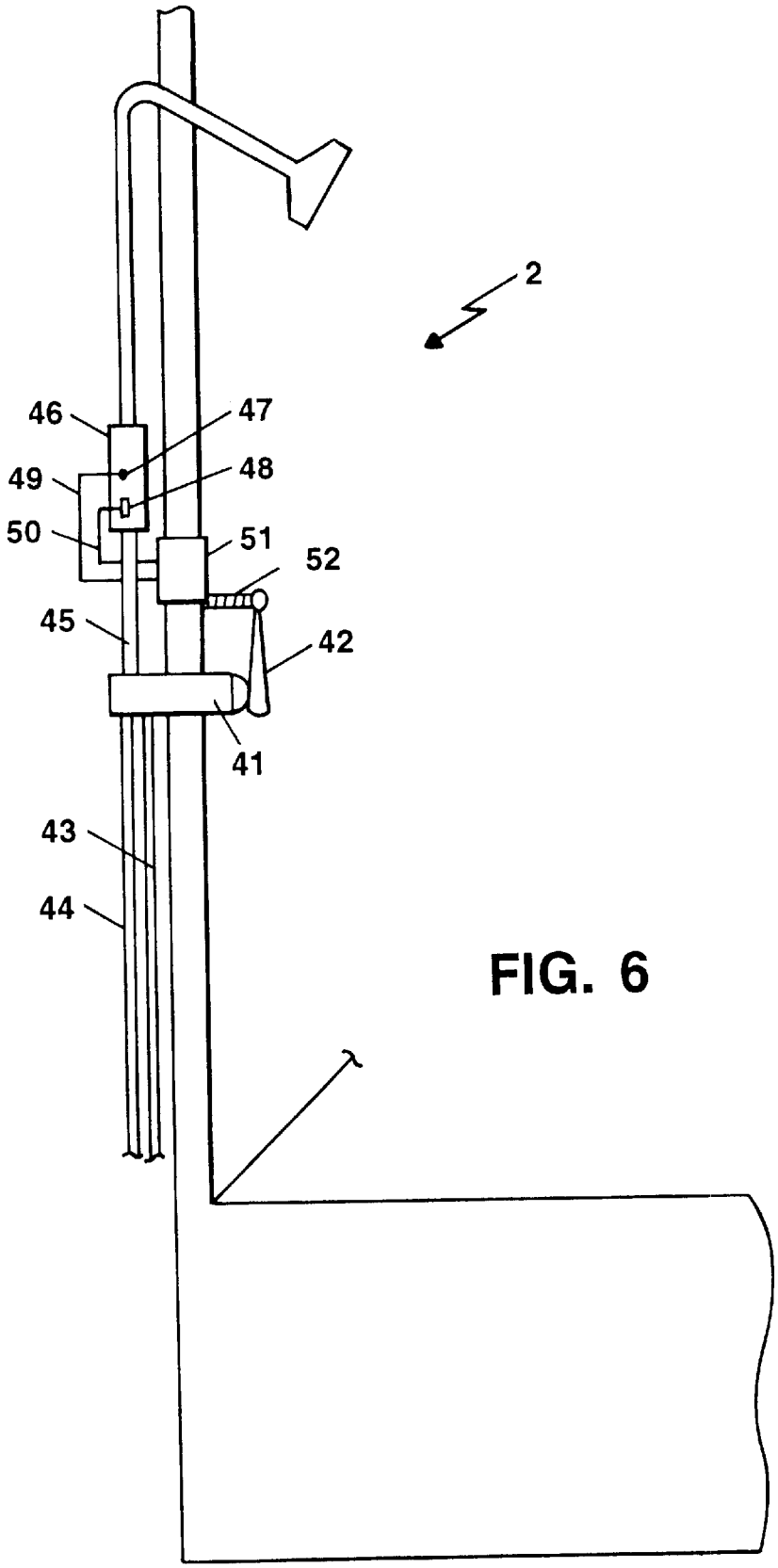
FIG. 6 illustrates a cut-away view of a shower stall and the system of the present invention.

When adapting the system of the present invention to an existing shower valve, all that is required is to cut the pipe 45, leading out of the valve 41, and insert the sensors module tube 46, in line with pipe 45. An appropriate perforation can be prepared within the stall's wall, where the control unit 51, see FIG. 7 is fit, and sealed to the wall with the skirt 57. In some embodiments, the sealing skirt may be flush with the front surface of the display, or somewhat protruding into the stall, as shown in FIGS. 6–7. The adapter 53, may be mounted on the lever's hand (permanently, or made to be removable). Once the unit 51 is powered, the system is ready to take control.

Good electrical isolation practices should be implemented when connecting any electrical appliance in a shower environment and assembling the control unit, 51. For instance, the power supply that convert AC to DC and provides DC power to the system, should be remotely positioned from the shower stall.

In operation, the CPU sets the valve through its drivers to a default position selected, typically, by the manufacturer. Once the system is installed and interfaced in a shower system, the user may select through the keypad, "U", the identity of the user for which setting can be fixed and memorized by the system. For instance, the user can press the pad "U" until his identity appears in the display under "U". In most domestic systems, one digit would suffice for that purpose. Once the correct identifying numeral is displayed, the user may press the pad "S", which will set the user identifier (ID) and this ID be displayed while programming the system for the user preferences.

Once the user ID is correctly displayed, the user may press the pad "P" to allow entry to either the flow or the temperature setting desired. The current (default or prior user) setting will be displayed under T and P respectively in the display. By selecting the increment or decrease pads for "T", the target temperature can be changed, and once the correct temperature is reached, pressing "S" will set this temperature in memory and assign it to the current user. Similarly, by pressing "P" again (program) and follow that by pressing the "F" (flow) increasing or decreasing pads, the flow can be set. Reentering the same user ID will cause the CPU to retrieve from memory the previously defined values for water temperature and flow rate for display to the user and control of the system to the user's specified preferences.

It should be clear that other programming algorithms could be easily implemented and simpler keypads envisioned. For instance, it is not necessary to have two increase/decrease sets of keypads which makes it possible to eliminate one such set altogether. In such an arrangement, after pressing "P", either the temperature display or the flow display can be made to flash. Then, pressing a single set of keypads (increase/decrease) followed by pressing "S" when the desired value is reached would suffice.

In operation, the temperature, and if desired, the water's flow rate, are constantly monitored and compared to the set values for the specific user. If a deviation is noted, signals are generated by the CPU to drive the appropriate motors to correct the deviation detected. To avoid excessive "overshoot" of the set conditions, well known process control principles, involving both sampling intervals and proportionality of the response to the deviation, can be employed.

It should be obvious to a person trained in the art that the system described herein is intended to be used as either original equipment or as an upgrade for existing shower systems.

Having described herein the preferred embodiments of the present invention, persons of ordinary skill in the art will appreciate various other features and advantages of the invention apart from those specifically described above. It should therefore be understood that the foregoing is only illustrative of the principles of the invention, and that various modifications and additions can be made by those skilled in the art without departing from the spirit and scope of the invention. Accordingly, the appended claims shall not by the particular features which have been shown and described, but shall be construed also to cover any obvious modifications and equivalents thereof.

What is claimed is:

1. An apparatus for use with a shower system having a shower head and a valve for controlling the admixture of both hot and cold water to the shower head, the valve configured to move relative to an axis and having a lever coupled thereto, motion of the valve lever around the valve axis controlling the admixture of both hot and cold water, and motion of the valve lever within a plane containing the valve axis controlling the water flow rate to the shower head, the apparatus comprising:

(a) at least one sensor disposed within a water flow path intermediate the valve and the shower head and configured to generate a sensor signal;

(b) a processing unit operatively coupled to the sensor and configured to process the sensor signal and generate control signals in response thereto;

(c) a user interface operatively coupled to the processing unit and capable of receiving user commands; and (d) a pair of motors, each coupled to the valve lever via a linear drive shaft.

2. The apparatus of claim 1 wherein the sensor comprises one of a temperature sensor and flow sensor.

3. The apparatus of claim 1 wherein the processing unit comprises a microprocessor.

4. The apparatus of claim 3 wherein the processing unit further comprises driver algorithms to control the motors.

5. The apparatus of claim 3 wherein the microprocessor comprises memory for storing any of user selectable values for water temperature, water flow rate or user identification.

6. The apparatus of claim 3 wherein user defined values for water temperature and flow rate are stored in the memory in association with a user identification value.

7. The apparatus of claim 1 wherein the user interface comprises a visual display for presenting graphic indicia associated with any of the water temperature, water flow rate or user identification.

8. The apparatus of claim 1 wherein the user interface comprises a keypad for receiving any of user-defined commands or data.

9. A kit comprising an apparatus for automating control of the water in a shower system, the shower system having a shower head and a valve for controlling the admixture of hot and cold water to the shower head, the valve configured to move relative to an axis and having a lever coupled thereto, motion of the valve lever around the valve axis controlling the admixture of hot and cold water, and motion of the valve lever within a plane containing the valve axis controlling the water flow rate to the shower head, the apparatus comprising:

(a) at least one sensor disposable within a water flow path intermediate the valve and the shower head and configured to generate a sensor signal;

(b) a processing unit operatively connectable to the sensor and configured to process the sensor signal and generate control signals in response thereto;

(c) a user interface operatively connectable to the processing unit and capable of receiving user commands; and (d) a pair of motors, each coupled to the valve lever via a linear drive shaft.

10. The kit of claim 9 wherein the sensor comprises one of a temperature sensor and flow sensor.

11. The kit of claim 9 wherein the apparatus further comprises:

a housing at least partially enclosing the processing unit, user interface, and motors in a substantially water tight seal.

* * * * *